US010800632B1

(12) United States Patent
Mallahan, III

(10) Patent No.: US 10,800,632 B1
(45) Date of Patent: Oct. 13, 2020

(54) TAPE CUTTING INSERTS

(71) Applicant: Lee G. Mallahan, III, Bossier City, LA (US)

(72) Inventor: Lee G. Mallahan, III, Bossier City, LA (US)

( * ) Notice: Subject to any disclaimer, the term of this patent is extended or adjusted under 35 U.S.C. 154(b) by 22 days.

(21) Appl. No.: 16/059,560

(22) Filed: Aug. 9, 2018

(51) Int. Cl.
*B65H 35/00* (2006.01)
*B26F 3/02* (2006.01)

(52) U.S. Cl.
CPC ..... *B65H 35/0026* (2013.01); *B65H 2402/10* (2013.01)

(58) Field of Classification Search
CPC ..... B65H 35/0026; B65H 2407/10; B65H 35/008; B65H 35/0086; B65H 35/0073; B65H 35/0056; B65D 85/02; B26F 3/02; B26F 2402/44; Y10T 225/247; Y10T 225/257; Y10T 225/252; Y10T 225/282; Y10T 225/0026; Y10T 225/269; Y10T 225/20; Y10T 225/238
USPC ..... 225/568, 62, 65, 89, 19, 22, 55, 56, 59, 225/60, 61, 77, 57, 66, 82, 91, 25, 47, 90, 225/39, 6; 156/242, 572, 584, 574; D19/67, 69
See application file for complete search history.

(56) References Cited

U.S. PATENT DOCUMENTS 2,140,729 A * 12/1938 Atwood ..... A61F 15/002 225/45
2,444,117 A * 6/1948 Sloane ..... B65H 35/0026 225/60
2,655,214 A 10/1953 Cleef
2,677,425 A 5/1954 Broyles
3,684,141 A 8/1972 Hall
3,970,230 A 7/1976 Horn
4,225,071 A * 9/1980 Laviano ..... B65H 35/008 225/65
4,405,068 A 9/1983 Blair
4,711,384 A 12/1987 Harris
5,363,997 A 11/1994 Harris
7,841,498 B1 11/2010 Rohrer
9,206,011 B1 12/2015 Mallahan, III
2006/0090843 A1 5/2006 Steinhardt et al.
2007/0295854 A1 12/2007 Thorp
(Continued)

*Primary Examiner* — Ghassem Alie
(74) *Attorney, Agent, or Firm* — R. Keith Harrison

(57) ABSTRACT

Tape cutting inserts suitable for cutting tape strips from a tape roll having a spool, a pair of spaced-apart spool flanges on the spool, a spool opening in the spool and opening through the pair of spool flanges, respectively, and tape wound on the spool between the pair of spool flanges. An illustrative embodiment of the tape cutting insert may include an insert panel having an inner panel surface, an outer panel surface opposite the inner panel surface, a cutting edge extending between the inner panel surface and the outer panel surface and a pair of elongated, parallel, spaced-apart flange receiving slots extending through the insert panel from the inner panel surface to the outer panel surface. In a stowage configuration of the insert panel, the insert panel may be configured to releasably engage the spool at the spool opening. In a functional, tape cutting configuration of the insert panel, the pair of flange receiving slots may be configured to accommodate the pair of spool flanges, respectively, on the spool. Tape cutting insert and tape roll combinations are also disclosed.

18 Claims, 10 Drawing Sheets

(56) References Cited

U.S. PATENT DOCUMENTS

2009/0302084 A1* 12/2009 Liu ..... B65H 35/0026
225/77
2018/0194586 A1* 7/2018 Tiedemann ..... B65H 35/0026

* cited by examiner

TAPE CUTTING INSERTS

FIELD

Illustrative embodiments of the disclosure generally relate to rolls and spools of tape and the like. More particularly, illustrative embodiments of the disclosure relate to tape cutting inserts which can be deployed in a stowage configuration on a roll or spool of tape and selectively removed from the stowage configuration and deployed in a functional, tape cutting configuration to incrementally cut strips of tape from the wound tape as the insert travels along the tape roll or spool.

SUMMARY

Illustrative embodiments of the disclosure are generally directed to tape cutting inserts suitable for cutting tape strips from a tape roll having a spool, a pair of spaced-apart spool flanges on the spool, a spool opening in the spool and opening through the pair of spool flanges, respectively, and tape wound on the spool between the pair of spool flanges. An illustrative embodiment of the tape cutting insert may include an insert panel having an inner panel surface, an outer panel surface opposite the inner panel surface, a cutting edge extending between the inner panel surface and the outer panel surface and a pair of elongated, parallel, spaced-apart flange receiving slots extending through the insert panel from the inner panel surface to the outer panel surface. In a stowage configuration of the insert panel, the insert panel may be configured to releasably engage the spool at the spool opening. In a functional, tape cutting configuration of the insert panel, the pair of flange receiving slots may be configured to accommodate the pair of spool flanges, respectively, on the spool.

Illustrative embodiments of the disclosure are further generally directed to tape cutting insert and tape roll combinations. An illustrative embodiment of the tape cutting insert and tape roll combinations may include a tape roll having a spool; a pair of spaced-apart spool flanges on the spool; a pair of outer flange rims on the pair of spool flanges, respectively; a spool opening in the spool and opening through the pair of spool flanges, respectively; and tape wound on the spool between the pair of spool flanges. A tape cutting insert may include an insert panel having an inner panel surface, an outer panel surface opposite the inner panel surface, a cutting edge extending between the inner panel surface and the outer panel surface and a pair of elongated, parallel, spaced-apart flange receiving slots extending through the insert panel from the inner panel surface to the outer panel surface. At least one spool engaging flange may extend from the inner panel surface of the insert panel. The at least one spool engaging flange may releasably engage the spool of the tape roll through the spool opening in a stowage configuration of the insert panel. In a functional, tape cutting configuration of the insert panel, the pair of flange receiving slots may be configured to accommodate the pair of spool flanges, respectively, on the spool.

BRIEF DESCRIPTION OF THE DRAWINGS

Illustrative embodiments of the disclosure will now be described, by way of example, with reference to the accompanying drawings, in which.

DETAILED DESCRIPTION

The following detailed description is merely exemplary in nature and is not intended to limit the described embodiments or the application and uses of the described embodiments. As used herein, the word "exemplary" or "illustrative" means "serving as an example, instance, or illustration." Any implementation described herein as "exemplary" or "illustrative" is not necessarily to be construed as preferred or advantageous over other implementations. All of the implementations described below are exemplary implementations provided to enable persons skilled in the art to make or use the embodiments of the disclosure and are not intended to limit the scope of the disclosure, which is defined by the claims. For purposes of description herein, the terms "upper", "lower", "left", "rear", "right". "front", "vertical", "horizontal", and derivatives thereof shall relate to the invention as oriented in FIG. 1. Furthermore, there is no intention to be bound by any expressed or implied theory presented in the preceding technical field, background, brief summary or the following detailed description. It is also to be understood that the specific devices and processes illustrated in the attached drawings, and described in the following specification, are simply exemplary embodiments of the inventive concepts defined in the appended claims. Hence, specific dimensions and other physical characteristics relating to the embodiments disclosed herein are not to be considered as limiting, unless the claims expressly state otherwise.

Figure 11:
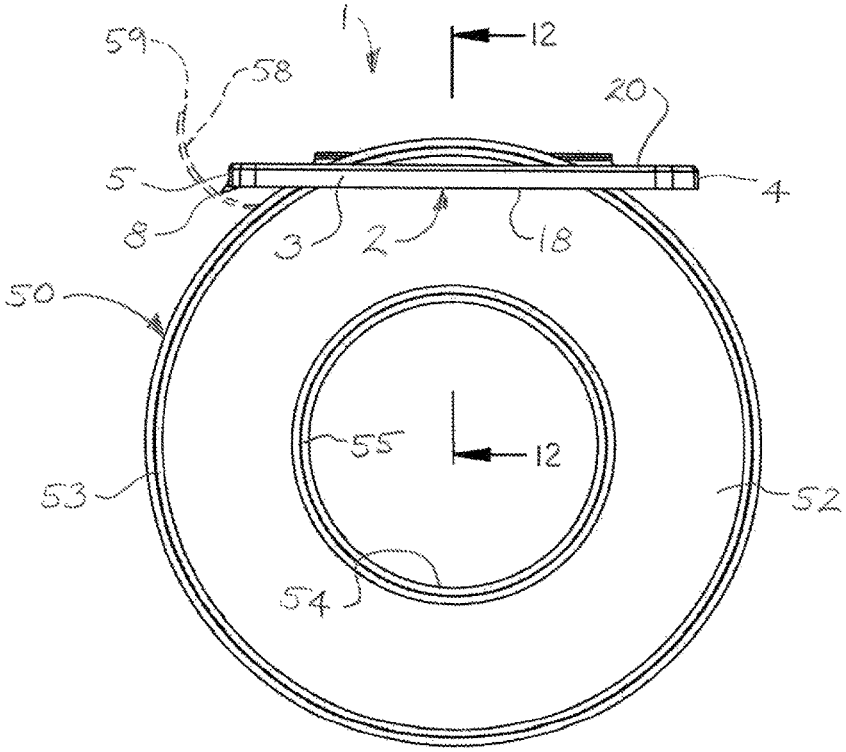
FIG. 11 is a side view of the illustrative tape cutting insert, deployed in the tape cutting configuration on the tape roll.

Referring to the drawings, an illustrative embodiment of the tape cutting insert is generally indicated by reference numeral 1. As illustrated in FIG. 11 and will be hereinafter described, the tape cutting insert 1 may be suitable for sequentially cutting strips of tape 58 (illustrated in phantom)

with a straight or uniform cutting edge 59 from a tape roll 50. The tape roll 50 may be conventional in design and may have a spool 51. A pair of spaced-apart spool flanges 52 may extend from opposite ends of the spool 51. Tape 56 may be wound on the spool 51 between the spool flanges 52. The spool 51 may have a spool opening 54 which opens through each of the spool flanges 52. In some applications, each spool flange 52 may have an outer flange rim 53. A concentric inner flange rim 55 on each spool flange 52 may encircle or circumscribe the spool opening 54. In some applications, the tape roll 50 may be a roll of medical or surgical tape.

As illustrated in FIGS. 1-8, in a stowage configuration, the tape cutting insert 1 may releasably engage the spool 51 at the spool opening 54 for packaging and/or storage of the tape cutting insert 1 with the tape roll 50. In a functional, tape cutting configuration, the tape cutting insert 1 may be removed from the stowage configuration on the spool 50 and engaged with the spool flanges 52, as illustrated in FIGS. 9-14, in spanning relationship to the spool flanges 52 for sequential cutting of the tape strips 58 from the tape 56 as the tape 56 is unwound from the spool 51. Throughout use of the tape 56, the tape cutting insert 1 may be slid along the spool flanges 52 for proper placement or positioning of the tape cutting insert 1 on the spool 50 to cut the next tape strip 58 from the tape 56.

Figure 1:
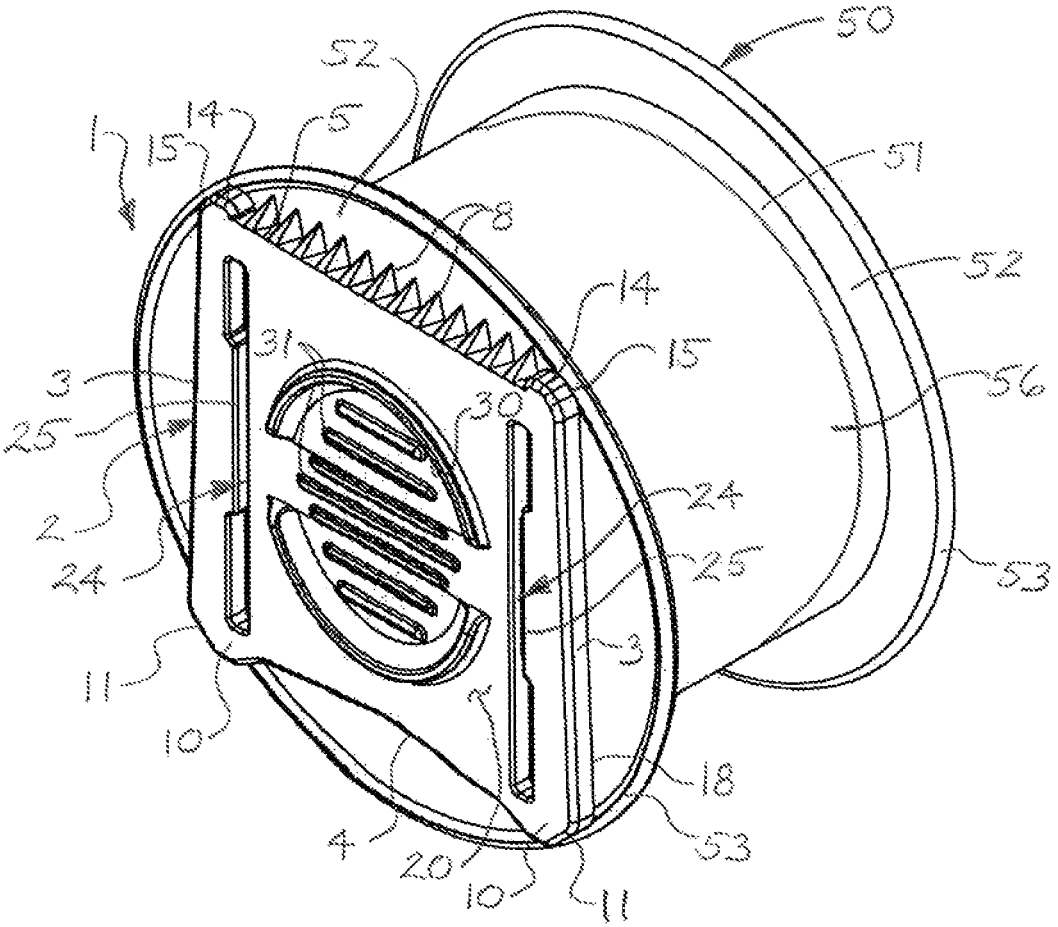
FIG. 1 is a front perspective view of an illustrative embodiment of the tape cutting inserts, deployed in a stowage configuration on a tape roll.
Figure 2:
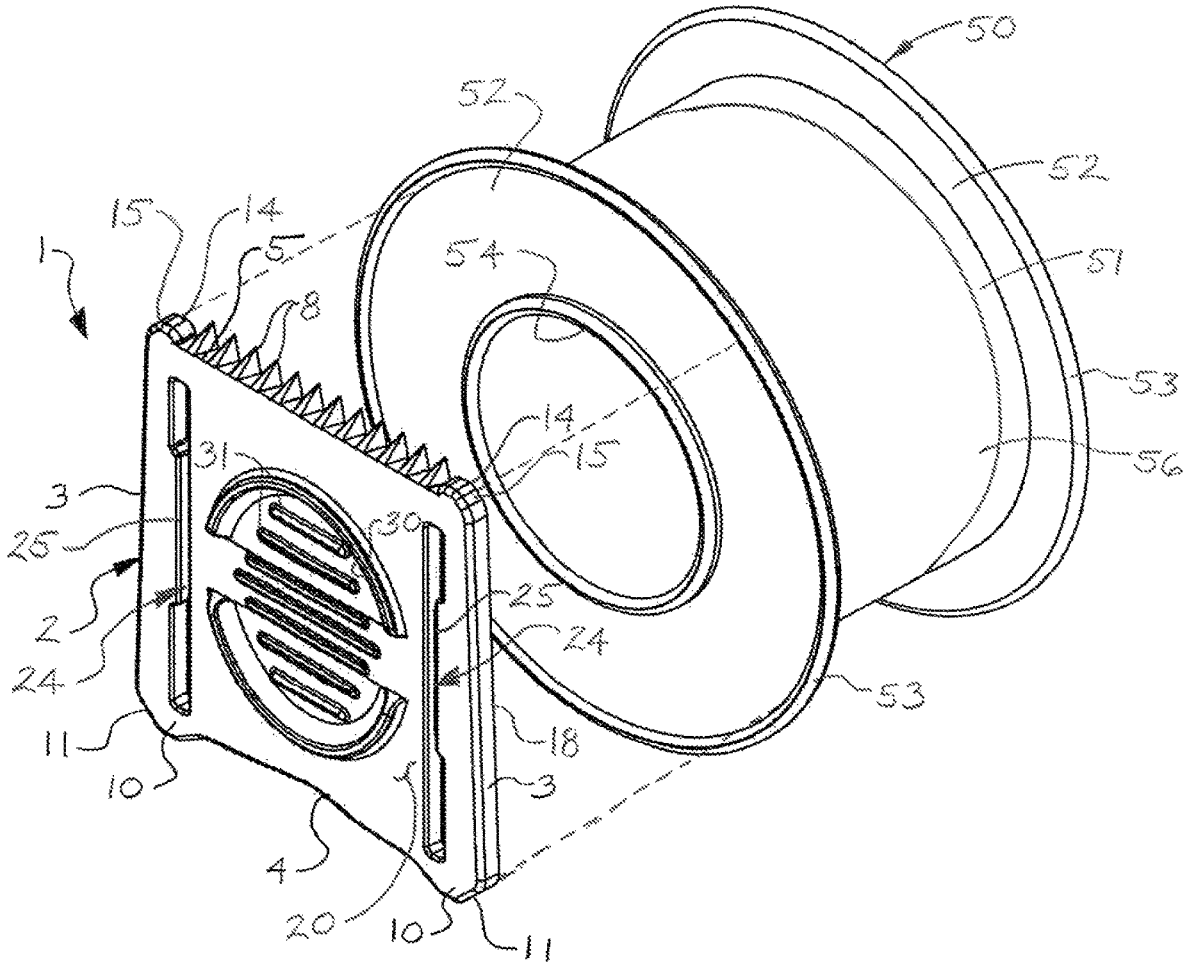
FIG. 2 is a front exploded perspective view illustrating typical deployment of the illustrative tape cutting insert in the stowage configuration on the tape roll.
Figure 3:
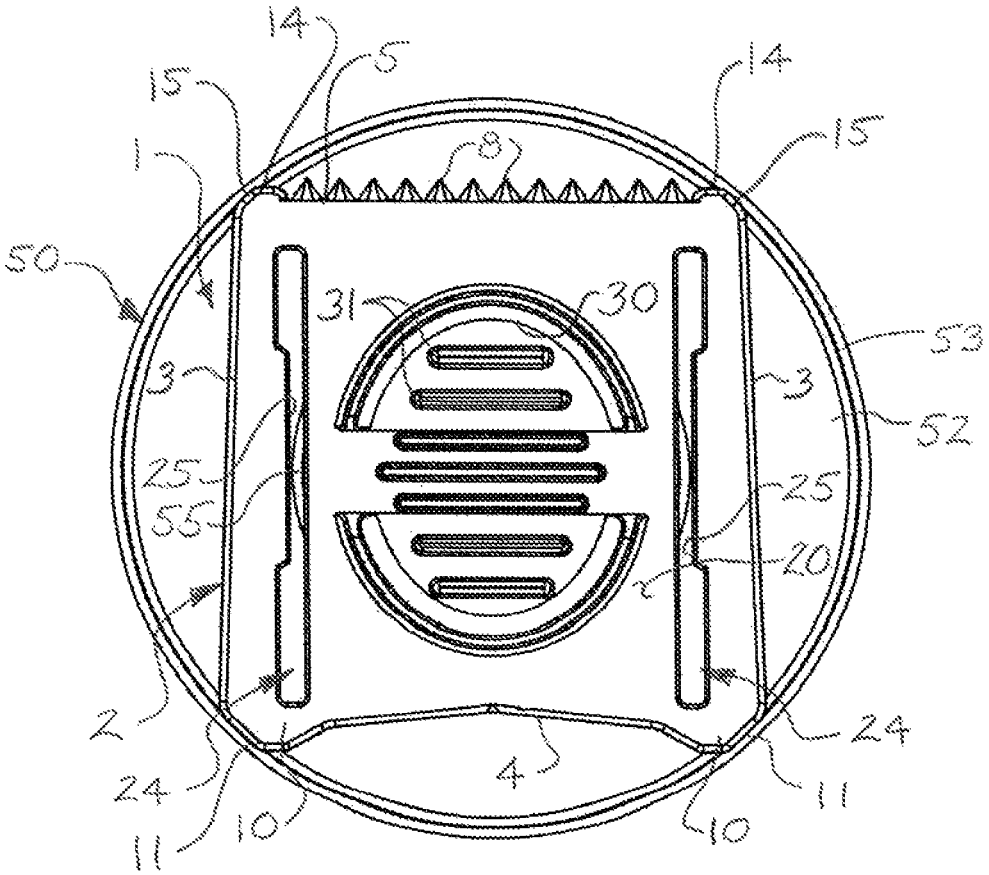
FIG. 3 is a front view of the illustrative tape cutting insert, deployed in the stowage configuration on the tape roll.
Figure 5:
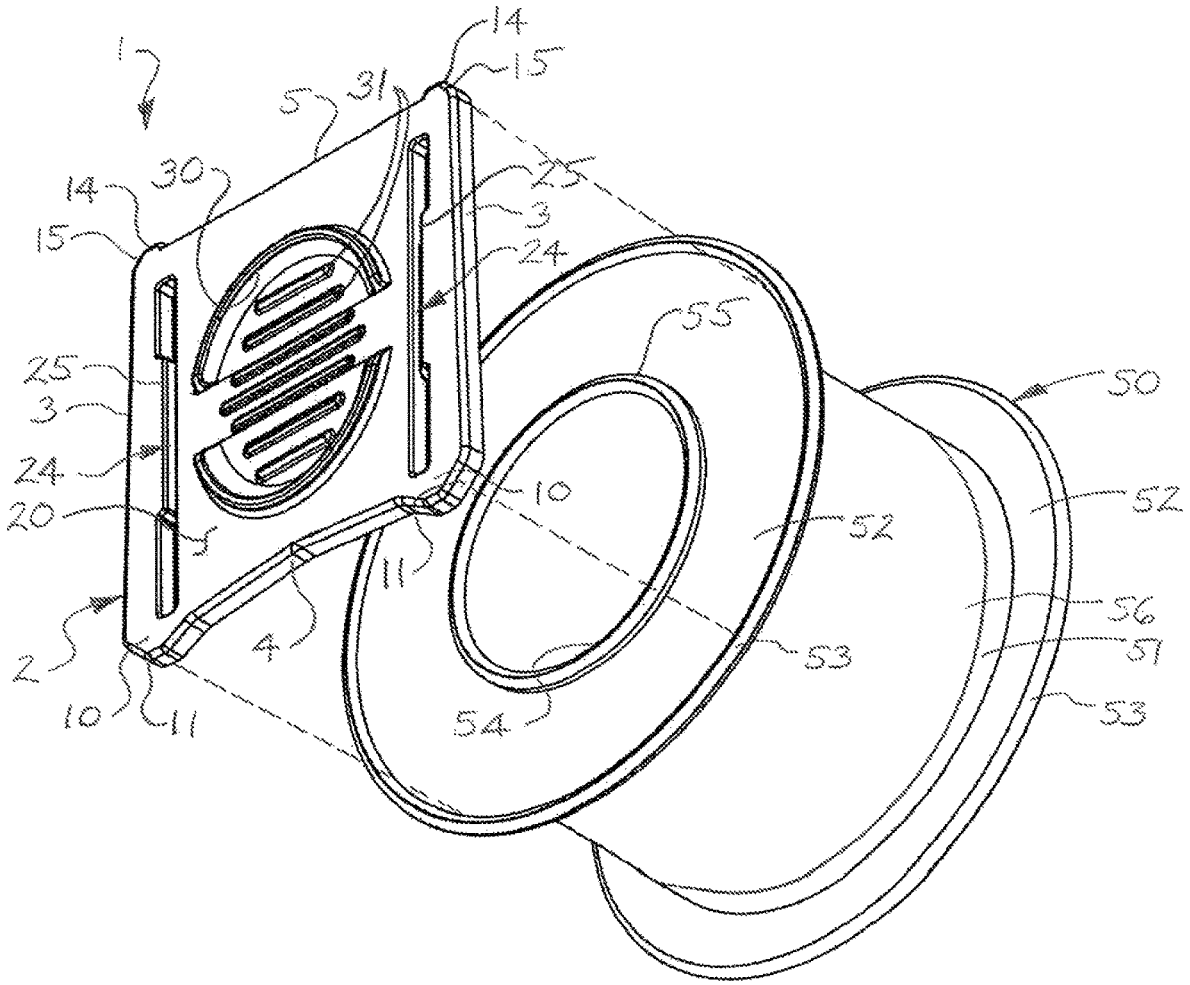
FIG. 5 is a bottom front exploded perspective view illustrating typical deployment of the illustrative tape cutting insert in the stowage configuration on the tape roll.
Figure 6:
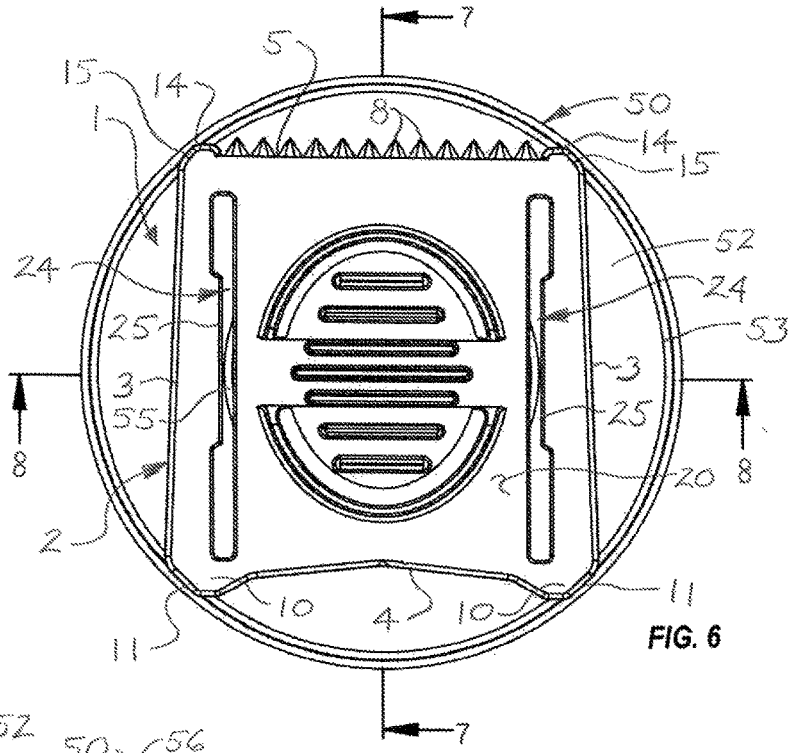
FIG. 6 is a front view of the illustrative tape cutting insert deployed in the stowage configuration on the tape roll.
Figure 7:
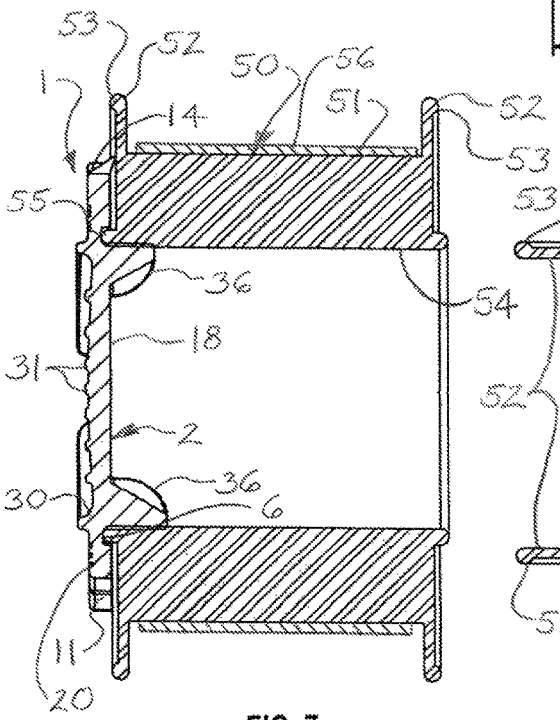
FIG. 7 is a cross-sectional view of the tape roll and tape cutting insert, taken along section lines 7-7 in FIG. 6.
Figure 8:
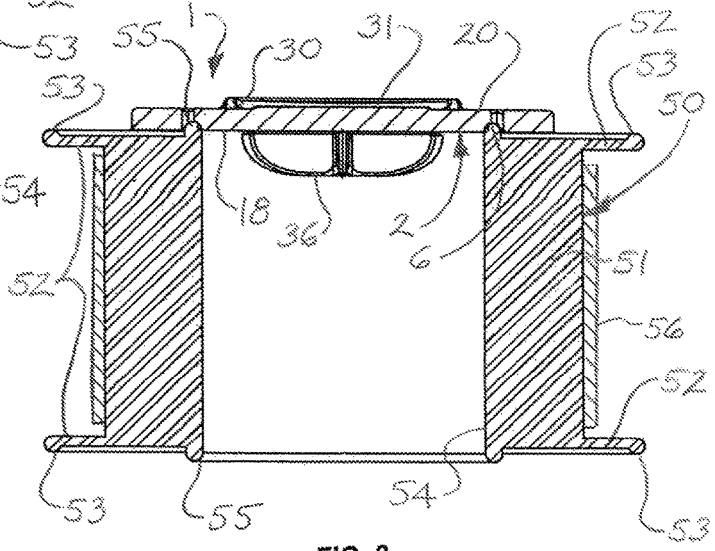
FIG. 8 is a cross-sectional view of the tape roll and tape cutting insert, taken along section lines 8-8 in FIG. 6.

The tape cutting insert 1 may include an insert panel 2. In some embodiments, the insert panel 2 may be fabricated of plastic, composite material, fiberglass or the like. In other embodiments, the insert panel 2 may be fabricated of aluminum, stainless steel and/or other heat-resistant, autoclavable material. As illustrated in FIGS. 7 and 8, the insert panel 2 may have an inner panel surface 18 and an outer panel surface 20 opposite the inner panel surface 18. The insert panel 2 may have a cutting edge 5 which extends between the inner panel surface 18 and the outer panel surface 20. As illustrated in FIGS. 1-3, in some embodiments, the cutting edge 5 may be serrated with multiple teeth 8. As illustrated in FIG. 5, in other embodiments, the cutting edge 5 may be non-serrated. Accordingly, the cutting edge 5 may have a sharpened knife edge which is molded, casted, machined or otherwise formed or shaped in the cutting edge 5. Alternatively, the cutting edge 5 may be suitable configured to receive and accommodate or facilitate attachment of a knife blade or edge which may be fabricated separately and attached to the cutting edge 5 using adhesives, mechanical fasteners and/or other technique known by those skilled in the art.

In some embodiments, the insert panel 2 may have a generally square or rectangular shape, as illustrated, with a pair of parallel, spaced-apart side insert panel edges 3. A rear insert panel edge 4 may extend between the side insert panel edges 3. The rear insert panel edge 4 may be concave, as illustrated. The cutting edge 5 may extend between the side insert panel edges 3 in spaced-apart relationship to the rear insert panel edge 4. In alternative embodiments, the insert panel 2 may have an alternative polygonal shape or may be round or oval, for example and without limitation.

In some embodiments, a pair of spaced-apart rear panel protuberances 10 may extend from the insert panel 2 at opposite ends of the rear insert panel edge 4. A pair of spaced-apart front panel protuberances 14 may extend from the insert panel 2 at opposite ends of the cutting edge 5. A beveled rear rim engaging surface 11 may be provided in each rear panel protuberance 10 and a beveled front rim engaging surface 15 may be provided in each front panel protuberance 14 for purposes which will be hereinafter described.

Figure 4:
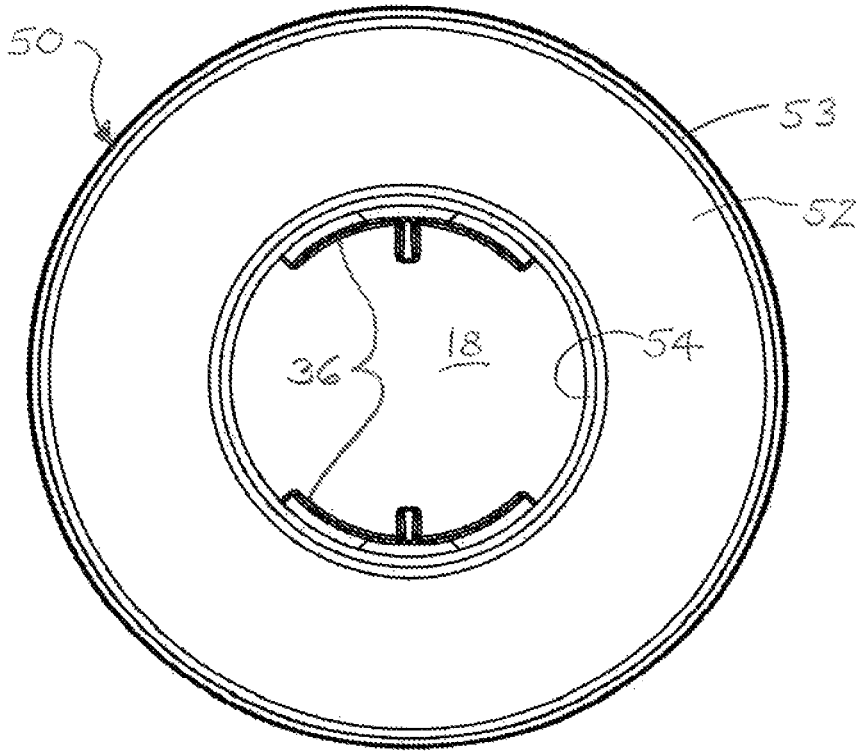
FIG. 4 is a rear view of the tape roll with the illustrative tape cutting insert deployed in the stowage configuration on the tape roll.

As illustrated in FIGS. 4 and 7, in some embodiments, at least one spool engaging flange 36 may extend from the inner panel surface 18 of the insert panel 2. In some embodiments, a pair of spaced-apart, semicircular spool engaging flanges 36 may extend from the inner panel surface 18, as illustrated in FIG. 4. The spool engaging flanges 36 may be suitably sized and configured to engage the spool 51 through the spool opening 54 in a friction-fit or interference-fit and releasably secure the insert panel 2 on the tape roll 50 in the stowage configuration illustrated in FIGS. 1-8.

As illustrated in FIGS. 7 and 8, in some embodiments, a rim cavity 6 may be provided in the inner panel surface 18 of the insert panel 2. The rim cavity 6 may have a diameter which corresponds to the diameter of the inner flange rim 55 on the spool 51 of the tape roll 50. Accordingly, in the stowage configuration of the tape cutting insert 1, the rim cavity 6 may accommodate the inner flange rim 55, as illustrated.

Figure 9:
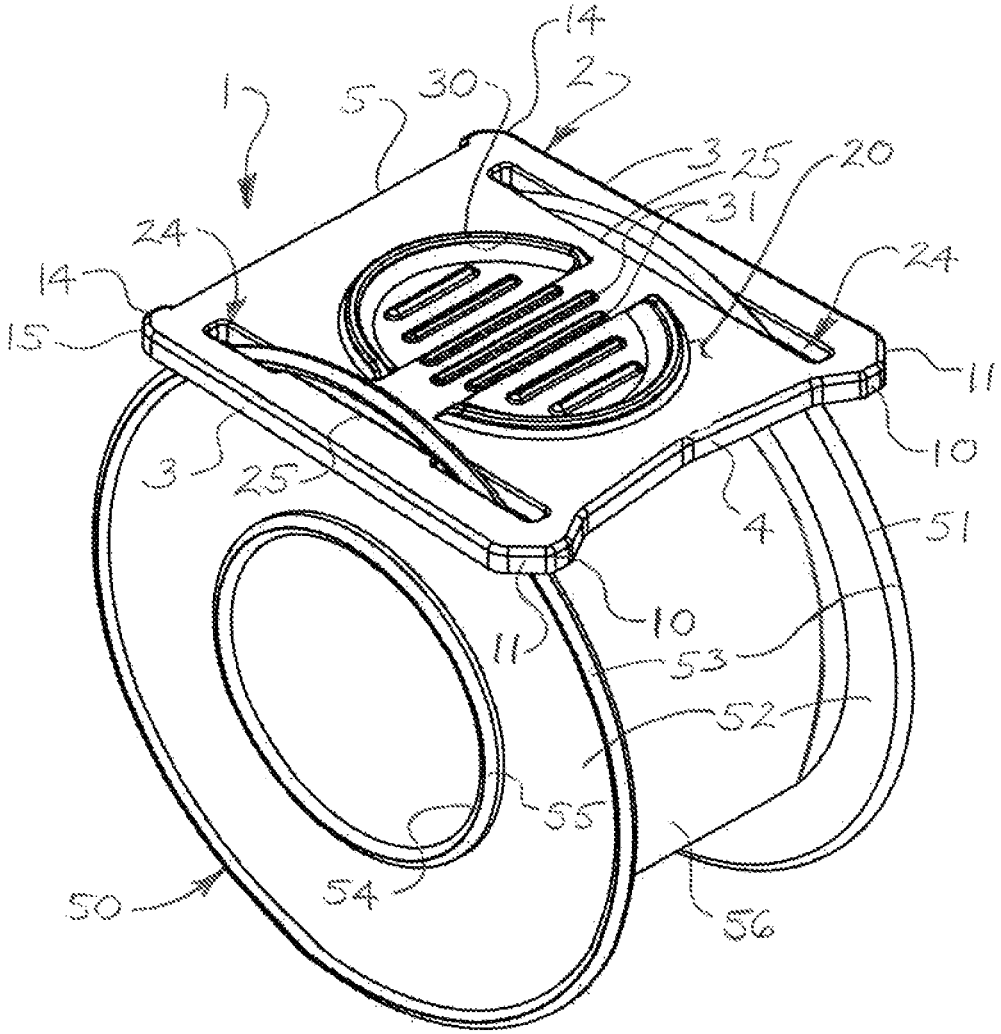
FIG. 9 is a top perspective view of the illustrative tape cutting insert, deployed in the functional, tape cutting configuration on the tape roll.

A pair of elongated, parallel, spaced-apart flange receiving slots 24 may extend through the insert panel 2 from the inner panel surface 18 to the outer panel surface 20. In the functional, tape cutting configuration of the insert panel 2, illustrated in FIGS. 9-14, the flange receiving slots 24 may accommodate the respective spool flanges 52 on the spool 51. In some embodiments, a rim tab 25 may protrude inwardly into each flange receiving slot 24. Accordingly, as illustrated in FIG. 9, each rim tab 25 may engage the outer flange rim 53 on the spool flange 52 to retain the insert panel 2 in the tape cutting configuration on the spool flanges 52.

In some embodiments, a finger depression 30 may be provided in the outer panel surface 20 of the insert panel 2. Finger ridges 31 may be provided in the finger depression 30. Accordingly, in the tape cutting configuration of the tape cutting insert 1, a user (not illustrated) may apply finger pressure against the finger depression 30 to hold or secure the tape cutting insert 1 on the spool flanges 52 of the tape roll 50 as the tape 56 is unwound from the spool 51 to cur or sever the tape strips 58 from the tape 56.

In typical application, the tape cutting insert 1 may initially be deployed in the stowage configuration on the tape roll 50 for packaging and/or storage with the tape roll 50. Accordingly, as illustrated in FIGS. 1-8, the insert panel 2 may be deployed in place on one of the spool flanges 52 by insertion of the spool engaging flanges 36 in the spool opening 54, as illustrated in FIGS. 4 and 7. Thus, the spool flanges 52 may engage the interior surface of the spool opening 54 in a friction- or interference-fit. As illustrated in FIGS. 7 and 8, the rim cavity 6 in the inner panel surface 18 of the insert panel 2 may receive the companion inner flange rim 55 which encircles the spool opening 54. In some applications, this expedient may enable the outer panel surface 20 of the insert panel 2 to lie flush with the outer flange rim 53 on the spool flange 52. As illustrated in FIG. 3, the beveled rear rim engaging surfaces 11 on the respective rear panel protuberances 10 and the beveled front rim engaging surfaces 15 on the respective front panel protuberances 14 may engage the outer flange rim 53 on the spool flange 52 to prevent inadvertent shifting movement of the insert panel 2 on the tape roll 50.

Figure 10:
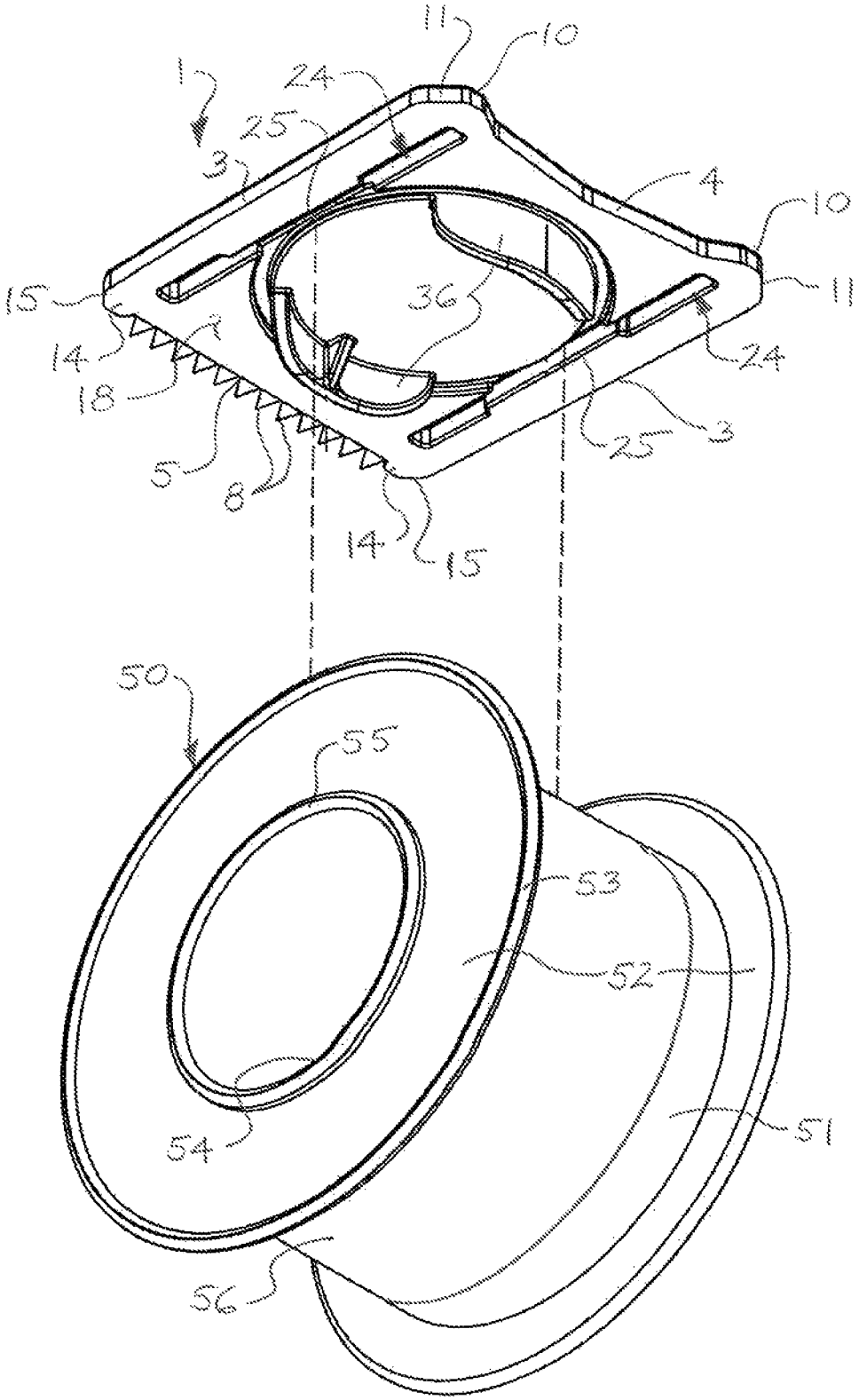
FIG. 10 is an exploded bottom perspective view illustrating typical deployment of the illustrative tape cutting insert on the tape roll in the tape cutting configuration.
Figure 12:
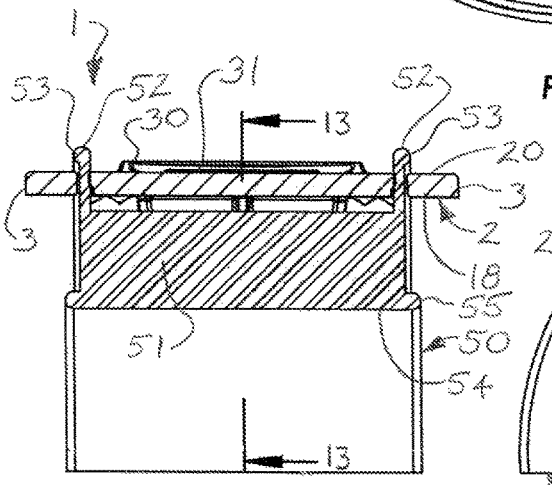
FIG. 12 is a cross-sectional view of the tape roll and tape cutting insert, taken along section lines 12-12 in FIG. 11.
Figure 13:
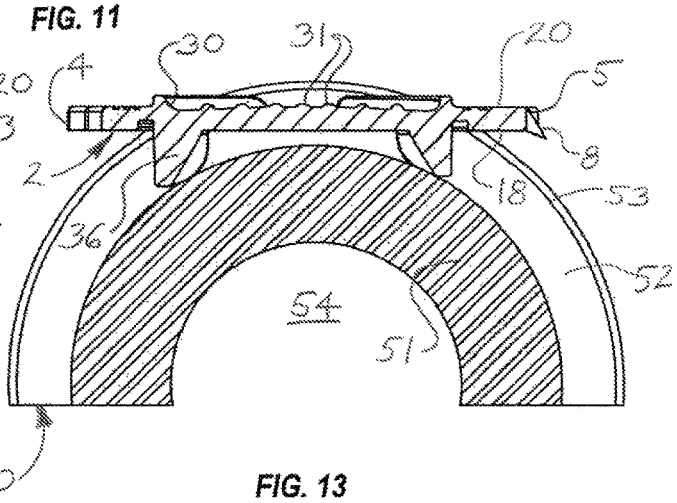
FIG. 13 is a cross-sectional view of the tape roll and tape cutting insert, taken along section lines 13-13 in FIG. 12.
Figure 14:
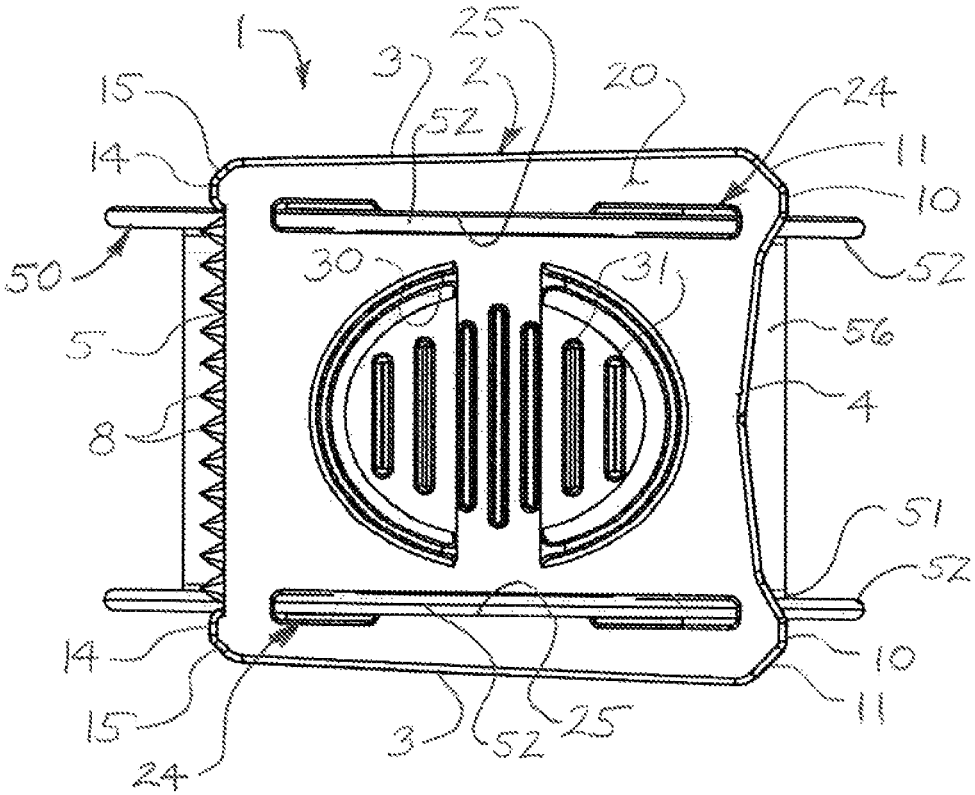
FIG. 14 is a top view of the illustrative tape cutting insert deployed in the tape cutting configuration on the tape roll.

The tape cutting insert 1 may be selectively detached from the tape roll 50 for deployment in the tape cutting configuration illustrated in FIGS. 9-14. Accordingly, removal of the tape cutting insert 1 from the tape roll 50 may initially be accomplished by extending a finger, pencil, pen or other object (not illustrated) into the spool opening 54 through the spool flange 52 which is opposite the spool flange 52 to which the tape cutting insert 1 is attached and applying outward pressure against the insert panel 2. This action may dislodge the spool engaging flanges 36 from the spool opening 54 and disengage the insert panel 2 from the spool flange 52. As illustrated in FIG. 10, the tape cutting insert 1 may then be repositioned such that the flange receiving slots 24 align or register with the respective spool flanges 52 on the spool 51 of the tape roll 50. The tape cutting insert 1 may then be lowered or moved toward the spool 51 until the flange receiving slots 24 receive the respective spool flanges 52 and the cutting edge 5 on the insert panel 2 spans the width of the tape 56 wound on the spool 51, with the spool flanges 52 protruding beyond the outer panel surface 20, as illustrated in FIGS. 11-13.

As illustrated in FIG. 11, a tape strip 58 having a selected length may next be peeled from the tape 56 wound on the spool 51. As the tape strip 58 is next pulled against and across the cutting edge 5 of the insert panel 2, finger pressure may be applied to the finger depression 30 in the outer panel surface 20 of the insert panel 2 to prevent the insert panel 2 from being removed from the spool flanges 52 of the spool 51 due to the outward pressure of the tape strip 58 against the cutting edge 5. The tape cutting insert 1 may then be slid along the spool flanges 52 as the spool flanges 52 rotate through the flange receiving slots 24 to reposition the tape cutting insert 1 at the appropriate position on the tape roll 50 preparatory to cutting the next tape strip 58 from the tape 56. After the supply of tape 56 on the tape roll 50 is exhausted, the tape cutting insert 1 may remain on and be discarded with the tape roll 50 or may alternatively be removed from the tape roll 50 and discarded. In some applications, the tape cutting insert 1 may be autoclaved for reuse.

While the illustrative embodiments of the disclosure have been described above, it will be recognized and understood that various modifications can be made in the disclosure and the appended claims are intended to cover all such modifications which may fall within the spirit and scope of the disclosure.

What is claimed is:

1. A tape cutting insert suitable for cutting tape strips from a tape roll having a spool, a pair of spaced-apart spool flanges on the spool, a spool opening in the spool and opening through the pair of spool flanges, respectively, and tape wound on the spool between the pair of spool flanges, the tape cutting insert comprising:

an insert panel including:

an inner panel surface;

an outer panel surface opposite the inner panel surface;

a cutting edge extending between the inner panel surface and the outer panel surface; and a pair of elongated, parallel, spaced-apart flange receiving slots extending through the insert panel from the inner panel surface to the outer panel surface;

in a stowage configuration of the insert panel, the insert panel configured to releasably engage the spool at the spool opening;

in a functional, tape cutting configuration of the insert panel, the pair of flange receiving slots configured to accommodate the pair of spool flanges, respectively, on the spool; and at least one spool engaging flange extending from the inner panel surface of the insert panel, the at least one spool engaging flange configured to releasably engage the spool through the spool opening in the stowage configuration of the insert panel.

2. The tape cutting insert of claim 1 wherein the at least one spool engaging flange comprises a pair of spaced-apart, semicircular spool engaging flanges.

3. The tape cutting insert of claim 1 further comprising a plurality of panel protuberances extending from the insert panel.

4. The tape cutting insert of claim 1 wherein the cutting edge comprises a non-serrated cutting edge.

5. The tape cutting insert of claim 1 wherein the cutting edge comprises a serrated cutting edge.

6. The tape cutting insert of claim 1 further comprising a pair of rim tabs extending into the pair of flange receiving slots, respectively.

7. A tape cutting insert suitable for cutting tape strips from a tape roll having a spool, a pair of spaced-apart spool flanges on the spool, a spool opening in the spool and opening through the pair of spool flanges, respectively, and tape wound on the spool between the pair of spool flanges, the tape cutting insert comprising:

an insert panel including:

an inner panel surface;

an outer panel surface opposite the inner panel surface;

a cutting edge extending between the inner panel surface and the outer panel surface; and a pair of elongated, parallel, spaced-apart flange receiving slots extending through the insert panel from the inner panel surface to the outer panel surface;

in a stowage configuration of the insert panel, the insert panel configured to releasably engage the spool at the spool opening;

in a functional, tape cutting configuration of the insert panel, the pair of flange receiving slots configured to accommodate the pair of spool flanges, respectively, on the spool;

a plurality of panel protuberances extending from the insert panel; and a plurality of beveled rim engaging surfaces on the plurality of panel protuberances, respectively.

8. A tape cutting insert suitable for cutting tape strips from a tape roll having a spool, a pair of spaced-apart spool flanges on the spool, a pair of outer flange rims on the pair of spool flanges, respectively, a spool opening in the spool and opening through the pair of spool flanges, respectively, and tape wound on the spool between the pair of spool flanges, the tape cutting insert comprising:

an insert panel including:

an inner panel surface;

an outer panel surface opposite the inner panel surface;

a cutting edge, a rear insert panel edge and a pair of spaced-apart side insert panel edges extending between the inner panel surface and the outer panel surface; and a pair of elongated, parallel, spaced-apart flange receiving slots extending through the insert panel from the inner panel surface to the outer panel surface;

at least one spool engaging flange extending from the inner panel surface of the insert panel;

in a stowage configuration of the insert panel, the at least one spool engaging flange configured to releasably engage the spool through the spool opening;

in a functional, tape cutting configuration of the insert panel, the pair of flange receiving slots configured to accommodate the pair of spool flanges, respectively, on the spool; and a plurality of panel protuberances extending from the insert panel and a plurality of beveled rim engaging surfaces on the plurality of panel protuberances, respectively.

9. The tape cutting insert of claim 8 wherein the cutting edge comprises a non-serrated cutting edge.

10. The tape cutting insert of claim 8 wherein the cutting edge comprises a serrated cutting edge.

11. The tape cutting insert of claim 8 wherein the at least one spool engaging flange comprises a pair of spaced-apart, semicircular spool engaging flanges.

12. The tape cutting insert of claim 8 further comprising a pair of rim tabs extending into the pair of flange receiving slots, respectively, each of the pair of rim tabs configured to engage a corresponding one of the pair of outer flange rims in the functional, tape cutting configuration of the insert panel.

13. The tape cutting insert of claim 8 further comprising a finger depression in the outer panel surface of the insert panel.

14. The tape cutting insert of claim 8 wherein the rear insert panel edge of the insert panel is concave.

15. A tape cutting insert and tape roll combination, comprising:

a tape roll including:

a spool;

a pair of spaced-apart spool flanges on the spool;

a pair of outer flange rims on the pair of spool flanges, respectively;

a spool opening in the spool and opening through the pair of spool flanges, respectively; and tape wound on the spool between the pair of spool flanges;

a tape cutting insert comprising:

an insert panel including:

an inner panel surface;

an outer panel surface opposite the inner panel surface;

a cutting edge extending between the inner panel surface and the outer panel surface; and a pair of elongated, parallel, spaced-apart flange receiving slots extending through the insert panel from the inner panel surface to the outer panel surface;

at least one spool engaging flange extending from the inner panel surface of the insert panel, the at least one spool engaging flange releasably engaging the spool of the tape roll through the spool opening in a stowage configuration of the insert panel; and in a functional, tape cutting configuration of the insert panel, the pair of flange receiving slots configured to accommodate the pair of spool flanges, respectively, on the spool.

16. The tape cutting insert and tape roll combination of claim 15 wherein the cutting edge comprises a non-serrated cutting edge.

17. The tape cutting insert and tape roll combination of claim 15 wherein the cutting edge comprises a serrated cutting edge.

18. The tape cutting insert and tape roll combination of claim 15 wherein the at least one spool engaging flange comprises a pair of spaced-apart, semicircular spool engaging flanges.

* * * * *